US008942869B2

(12) United States Patent
Woo et al.

(10) Patent No.: US 8,942,869 B2
(45) Date of Patent: Jan. 27, 2015

(54) METHOD AND APPARATUS FOR POSITIONING A RAIL VEHICLE OR RAIL VEHICLE CONSIST

(75) Inventors: Derek Kevin Woo, Melbourne, FL (US); Carlos Sabino Paulino, Melbourne, FL (US); Ralph C. Haddock, III, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 131 days.

(21) Appl. No.: 13/617,897

(22) Filed: Sep. 14, 2012

(65) Prior Publication Data

US 2014/0077040 A1 Mar. 20, 2014

(51) Int. Cl.
*B61L 3/18* (2006.01)

(52) U.S. Cl.
USPC ..... 701/20; 701/2; 246/4

(58) Field of Classification Search
CPC ..... B60T 13/665; B60T 17/22; B60T 17/228; B61C 17/12; B61L 2205/00; B61L 12/028; B61L 15/0027; B61L 27/00; B61L 27/0038; B61L 27/02; B61L 3/18
USPC ..... 701/20, 19, 2; 246/4, 184, 186, 122 R
See application file for complete search history.

(56) References Cited

U.S. PATENT DOCUMENTS 5,511,749 A 4/1996 Horst et al.
5,720,455 A 2/1998 Klemanski et al.
5,738,311 A 4/1998 Fernandez
5,740,547 A 4/1998 Kull et al.
5,785,392 A 7/1998 Hart
5,813,635 A 9/1998 Fernandez
5,820,226 A 10/1998 Hart
5,833,325 A 11/1998 Hart
5,927,822 A 7/1999 Hart
5,934,764 A 8/1999 Dimsa et al.
5,950,967 A 9/1999 Montgomery
5,969,643 A 10/1999 Curtis
5,978,718 A 11/1999 Kull
5,986,577 A 11/1999 Bezos
5,986,579 A 11/1999 Halvorson
5,995,881 A 11/1999 Kull
6,114,974 A 9/2000 Halvorson
(Continued)

FOREIGN PATENT DOCUMENTS

WO WO9960735 A1 11/1999
WO WO2010039680 A1 4/2010
ZA 200101708 A 8/2001

OTHER PUBLICATIONS

Australian Examination Report issued in connection with corresponding AU Application No. 2012238295 on Jun. 2, 2014.

*Primary Examiner* — Tan Q Nguyen
(74) *Attorney, Agent, or Firm* — GE Global Patent Operation; John A. Kramer

(57) ABSTRACT

A tower control system, under an indexing mode of operation, receives a first signal from rail yard equipment. In response to the first signal, the tower control system establishes a positioning mode of operation. Under the positioning mode of operation, and in response to actuation of an interface of the tower control system, the tower control system sends a second signal to a lead powered rail vehicle of a consist. The second signal includes a first command to adjust a throttle setting of the lead powered rail vehicle, along with a second command to idle a throttle of any remote powered rail vehicle of the consist.

13 Claims, 5 Drawing Sheets

(56) References Cited

U.S. PATENT DOCUMENTS

| | | | | |
|---|---|---|---|---|
| 6,128,558 | A | 10/2000 | Kernwein | |
| 6,163,089 | A | 12/2000 | Kull | |
| 6,216,095 | B1 | 4/2001 | Glista | |
| 6,275,165 | B1 | 8/2001 | Bezos | |
| 6,322,025 | B1 | 11/2001 | Colbert et al. | |
| 6,360,998 | B1 | 3/2002 | Halvorson et al. | |
| 6,377,215 | B1 | 4/2002 | Halvorson et al. | |
| 6,782,044 | B1 | 8/2004 | Wright et al. | |
| 6,789,004 | B2 | 9/2004 | Brousseau et al. | |
| 6,854,691 | B2 * | 2/2005 | Kraeling et al. | 246/2 F |
| 6,856,865 | B2 * | 2/2005 | Hawthorne | 701/19 |
| 6,969,235 | B2 * | 11/2005 | Feest | 415/229 |
| 7,416,262 | B2 | 8/2008 | Ring | |
| 7,520,472 | B2 * | 4/2009 | Peltz et al. | 246/187 A |
| 8,157,218 | B2 | 4/2012 | Riley et al. | |
| 8,428,798 | B2 | 4/2013 | Kull | |
| 8,676,410 | B2 * | 3/2014 | Houpt et al. | 701/19 |
| 2005/0121971 | A1 | 6/2005 | Ring | |
| 2010/0235022 | A1 * | 9/2010 | Siddappa et al. | 701/20 |
| 2012/0259488 | A1 | 10/2012 | Siddappa et al. | |
| 2012/0290157 | A1 | 11/2012 | Siddappa et al. | |

* cited by examiner

METHOD AND APPARATUS FOR POSITIONING A RAIL VEHICLE OR RAIL VEHICLE CONSIST

BACKGROUND

1. Technical Field

Embodiments of the invention relate generally to control systems for rail vehicles. Other embodiments relate to control systems for positioning trains using rail vehicle traction motors and/or braking systems.

2. Discussion of Art

Rail car switching, shunting, and classification are integral aspects of rail freight operations. These procedures are performed in switching yards or classification yards, which include multiple rail tracks branching from one or more lead tracks and joining together at one or more exits. To maximize operational efficiency, several cars or trains of cars are typically moving simultaneously along different branches within a yard. Due to the presence of multiple stationary rail cars or stub trains on intervening tracks, an operator in a locomotive moving on a first track may not be able to see moving cars on a track branching from the first track. Accordingly, locomotive operators may coordinate their actions via a yardmaster stationed in a control tower overlooking the yard.

Three-way communication between operators and a yardmaster can introduce lag time and error, which can be undesirable while moving multiple pieces of heavy rail equipment. As such, some yards include systems by which a yardmaster may remotely control and coordinate movement of multiple stub trains ("tower control systems").

Previous attempts to properly position trains relied upon manual intervention to control throttle and brakes while attempting to observe train position, using systems not integrated with a tower control system. For example, to position a train being operated by the tower control system under a speed control mode, the train would have to be unlinked from the tower control system and an onboard crew would have to move the train. Such non-integrated or unlinked controls potentially reduce efficacy of the tower control system.

For trains carrying bulk cargo such as ore or coal (for example), the bulk cargo is unloaded at a rail yard. At some rail yards, unloading equipment is deployed at the rail yard for controllably interacting with the train for dumping the bulk cargo. For example, when trains enter mining unloading equipment, they may be moved into position via an external indexing arm. In certain cases, external forces (wind, grade, etc.) can cause the train to move slightly out of position once the indexing arm retracts. This can lead to impacts between the train and the unloading equipment, and the possibility of the train being in contact with the unloading equipment with a sufficient degree of force to prevent the unloading equipment from functioning properly.

As will be appreciated, it may be desirable to provide a method and apparatus to reposition a train at a rail yard, which is different from existing systems.

BRIEF DESCRIPTION

In aspects, a tower control system, under an indexing mode of operation, receives a first signal from rail yard equipment. Rail yard equipment may include indexing equipment, which moves rail vehicles as further discussed below. Rail yard equipment also may include loading or unloading equipment, which can be configured to sense whether rail vehicles are appropriately positioned for receiving or discharging cargo. In response to the first signal, the tower control system establishes a positioning mode of operation. Under the positioning mode of operation, and in response to actuation of an interface of the tower control system (e.g., a manually operable user interface), the tower control system sends a second signal to a lead powered rail vehicle of a rail vehicle consist. The second signal includes a first command to adjust a throttle setting of the lead powered rail vehicle, along with a second command to idle a throttle of any remote powered rail vehicle of the rail vehicle consist.

In another embodiment, a system for remotely controlling a rail vehicle consist comprises a tower control system configured for communication with the rail vehicle consist and to receive a first signal from rail yard equipment. The tower control system includes an interface, e.g., a manually operable user interface. The tower control system is configured to transition from an indexing mode of operation to a positioning mode of operation responsive to receiving the first signal. The tower control system, when operative in the positioning mode of operation and in response to actuation of the interface, is configured to send from the tower control system a second signal to a lead powered rail vehicle of the rail vehicle consist. The second signal comprises a first command to adjust a throttle setting of the lead powered rail vehicle and a second command to idle a throttle of any remote powered rail vehicle of the rail vehicle consist.

In embodiments, a system, e.g., a tower control system for controlling rail vehicles, includes an off-board control unit and an operator control unit. The off-board control unit is operatively connected with the operator control unit, and is configured for communication with an on-board transceiver, which is mounted in a rail vehicle and operatively connected with at least one power system of the rail vehicle. The off-board control unit is further configured for communication with rail yard equipment disposed in a rail yard proximate the rail vehicle, e.g., the rail vehicle may be in the rail yard or approaching the rail yard. The operator control unit includes a selector manually movable to a plurality of pre-determined positions, such that in response at least to movement of the selector among the pre-determined positions, the off-board control unit establishes corresponding modes of operation. The off-board control unit is configured to establish a positioning mode of operation, corresponding to one of the pre-determined positions of the selector, in response to a first signal received from the rail yard equipment. In the positioning mode of operation, the off-board control unit is configured to transmit to the on-board transceiver second signals (e.g., a series of command signals) for positioning the rail vehicle independently from a rail vehicle consist of which the rail vehicle is a part.

In embodiments, a system for controlling a rail vehicle includes an on-board transceiver mounted in the rail vehicle and operatively connected with at least one power system of the rail vehicle. The on-board transceiver is configured to receive from an off-board control unit, not mounted in the rail vehicle, command signals for positioning the rail vehicle independently from a rail vehicle consist of which the rail vehicle is a part. The command signals include a signal for setting a throttle control (e.g., notch mode) of the rail vehicle, a signal for adjusting a braking parameter of the rail vehicle, and a signal for discontinuing a distributed power control mode of operation of the rail vehicle.

DRAWINGS

The present invention will be better understood from reading the following description of non-limiting embodiments, with reference to the attached drawings, wherein below:

DETAILED DESCRIPTION

Figure 1:
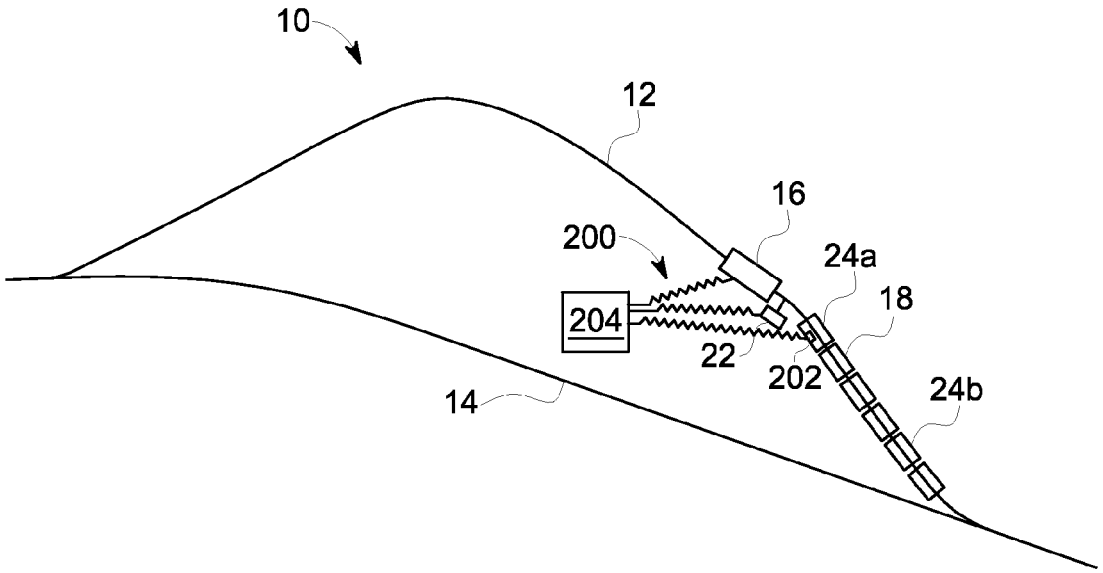
FIG. 1 illustrates in schematic view a bulk cargo unloading operation including a tower control system according to an embodiment of the present invention.

Reference will be made below in detail to exemplary embodiments of the invention, examples of which are illustrated in the accompanying drawings. Wherever possible, the same reference characters used throughout the drawings refer to the same or like parts. Although exemplary embodiments of the present invention are described with respect to mining operations, embodiments of the invention also are applicable for use with cargo unloading, generally.

Aspects of the invention relate to a tower control system for positioning a train or other rail vehicle consist over short distances. In certain aspects, the invention relates to a tower control system for positioning a train or other rail vehicle consist within bulk cargo handling equipment, such as a rotary dumper or loader chute, in order to prevent impact of the rail vehicle consist against unloading equipment. As further discussed below, operation of such equipment can require closely coordinating linear movement of a rail vehicle consist along a loading track, with simultaneous adjustment of bulk cargo flow from a dump chute into open cars of the rail vehicle consist. Alternatively, operation of a rotary dumper can require precise positioning of a single car within the rail vehicle consist, so as to avoid damage to the rail vehicle consist and to the dumper when the car is rotated about its lengthwise axis. Such short-distance positioning is sometimes referred to as "indexing," in which the rail vehicle consist or a vehicle within the rail vehicle consist is moved by less than or at most a single wagon length.

As used herein, a consist is a group of vehicles that are mechanically linked to travel together along a route. For example, a rail vehicle consist is a group of rail vehicles that are mechanically linked to travel together along a track. A powered rail vehicle is a rail vehicle that is capable of self propulsion. A non-powered rail vehicle is a rail vehicle that is incapable of self propulsion. Locomotives are examples of powered rail vehicles, and certain passenger cars, box cars, flatbed cars, and ore/mining cars are examples of non-powered rail vehicles. A train comprising at least one locomotive, and possibly one or more ore/mining cars or other cargo cars, is an example of a rail vehicle consist. Plural interconnected self-propelled mining ore carts is another example of a rail vehicle consist. Wagon refers to a rail vehicle for carrying cargo.

According to aspects of the present invention, and with reference to FIG. 1, a typical bulk cargo unloading operation 10 includes a loop of track 12 (or other section of track) connected from a main rail line 14 through loading/unloading equipment 16. In the loading/unloading equipment 16, coal/iron ore/other bulk products are dumped into or out of a wagon 18 of a train or other rail vehicle consist 20 that is positioned on the loop of track 12. For example, the loading/unloading equipment 16 may include a dumper chute (which directs a continuous flow of bulk material into a wagon positioned below the chute) or a rotary dumper cage (which inverts a wagon positioned in the dumper cage).

When the rail vehicle consist 20 is adjacent the equipment 16, it typically is in an "indexing" mode of operation, in which independent and automatic brakes are released while powered rail vehicle throttles are idled. Thus, indexing equipment 22 may be used to ensure that each wagon 18 is properly positioned in its turn for operation of the equipment 16. However, the indexing equipment 22 may have a limited range of motion, sometimes less than a full car length. Therefore, one or more powered rail vehicles 24 of the rail vehicle consist 20 is/are repeatedly throttled and braked—typically in a speed control mode—to move each wagon 18 in turn into position for engagement by the indexing equipment 22. Then, the indexing equipment 22 performs a final adjustment of the wagon 18 under the indexing mode. Once the wagon 18 is positioned, independent and/or automatic brakes are set to hold position of the rail vehicle consist 20 and of the wagon. ("Independent brakes" means the brakes of each locomotive or other powered rail vehicle 24 within the rail vehicle consist 20, which can be controlled independently of the "automatic brakes" that are installed on each train wagon 18. The automatic brakes installed on the train wagons 18 are operable all together and are also referred to as "train brakes.")

Desirably, each wagon 18 is positioned by the indexing equipment 22 only within the "slack action" of the adjoining couplers. "Slack action" is a typical result of rail vehicle consist dynamics when brakes are applied from front to back: each wagon 18 approaches the preceding wagon or locomotive or other powered rail vehicle 24, such that tension is taken off the connecting couplers. Thus, slack action is inherent to a positioning operation where only a lead (e.g., forward) powered rail vehicle **24*a* is used for positioning the entire rail vehicle consist 20. Advantageously, slack action relieves the indexing equipment 22 from exerting the force that might otherwise be required to move multiple loaded wagons 18. However, due to the slack action, motion within the rail vehicle consist 20 can occur after the indexing equipment 22 is retracted. In particular, movement of a wagon 18 by the indexing equipment 22 away from an equilibrium of its slack action, can establish a restoring force within the adjacent couplers, such that after the indexing equipment retracts, the wagon returns to equilibrium. Thus, slack action can create a situation where a wagon 18 has been positioned by the indexing equipment 22, but then is pulled out of position. Also, in certain cases, external forces (wind, grade, etc.) can cause a wagon 18 to move slightly out of position once the indexer 22** retracts.

Motion of a wagon 18, after indexing, can lead to impacts between the wagon 18 and the equipment 16. After-indexing motion also can lead to a condition where the wagon 18 rests against the loading/unloading equipment 16 with sufficient force to interfere with operation of the equipment. Such impacts or interferences can damage the rail vehicle consist and/or the unloading equipment, causing repair expense and downtime.

Accordingly, the unloading operation 10 can be controlled by an improved tower control system 200 that is configured for a positioning mode. The tower control system 200 is commissioned upon delivery, based on topography of the rail loop 12 (or other section of track) and based on data describing a template consist. Consist data may include, for example, the numbers, locations, and loaded and empty weights of wagons 18 and locomotives or other powered rail vehicles 24 within the rail vehicle consist 20. Typically, all of the rail vehicle consists used for a given bulk cargo unloading operation are set up to match a "template" consist that is determined by the number of wagons and locomotives or other powered rail vehicles that can fit on the previously mentioned loop (or other section) of track 12 without spilling over onto the main rail line 14. In some aspects of the invention, topography of the loop (or other section) of track 12 may also play a role in determining the template consist for a particular mine unloading operation or other unloading operation.

In some aspects of the invention, during commissioning of the tower control system 200, parameters of the tower control system are set to provide for desired response of the rail vehicle consist 20 to any command for movement, at any location within the unloading operation 10 that is controlled by the tower control system. For example, speed control mode parameters can be configured corresponding to various lead powered rail vehicle 24*a* locations, such that when the tower control system 200 receives a requested speed for the rail vehicle consist 20, appropriate throttle and/or brake control signals can be sent from the tower control system to the lead and remote powered rail vehicles 24*a*, 24*b* of the rail vehicle consist for achieving the requested speed. Moreover, positioning mode parameters can be configured corresponding to various lead powered rail vehicle 24*a* locations, such that when the tower control system 200 receives a request to stop or park the rail vehicle consist 20, appropriate brake control signals can be sent to the lead powered rail vehicle and to remote powered rail vehicles 24*b* for holding the position of the rail vehicle consist 20.

In some aspects, by allowing a tower operator to order small movements of the rail vehicle consist by discrete control of a throttle joystick, button, or other interface of the tower control system 200, and by maintaining a throttle command until brakes have reached a sufficient level to prevent movement when the throttle is idled, the rail vehicle consist 20 can be moved and held in a position where impacts or other interference with the unloading equipment 16 are prevented. In selected aspects, a positioning mode is integrated into the tower control system 200, whereby all tower control safety interlocks are present and enforced during consist positioning movements.

Figure 2:
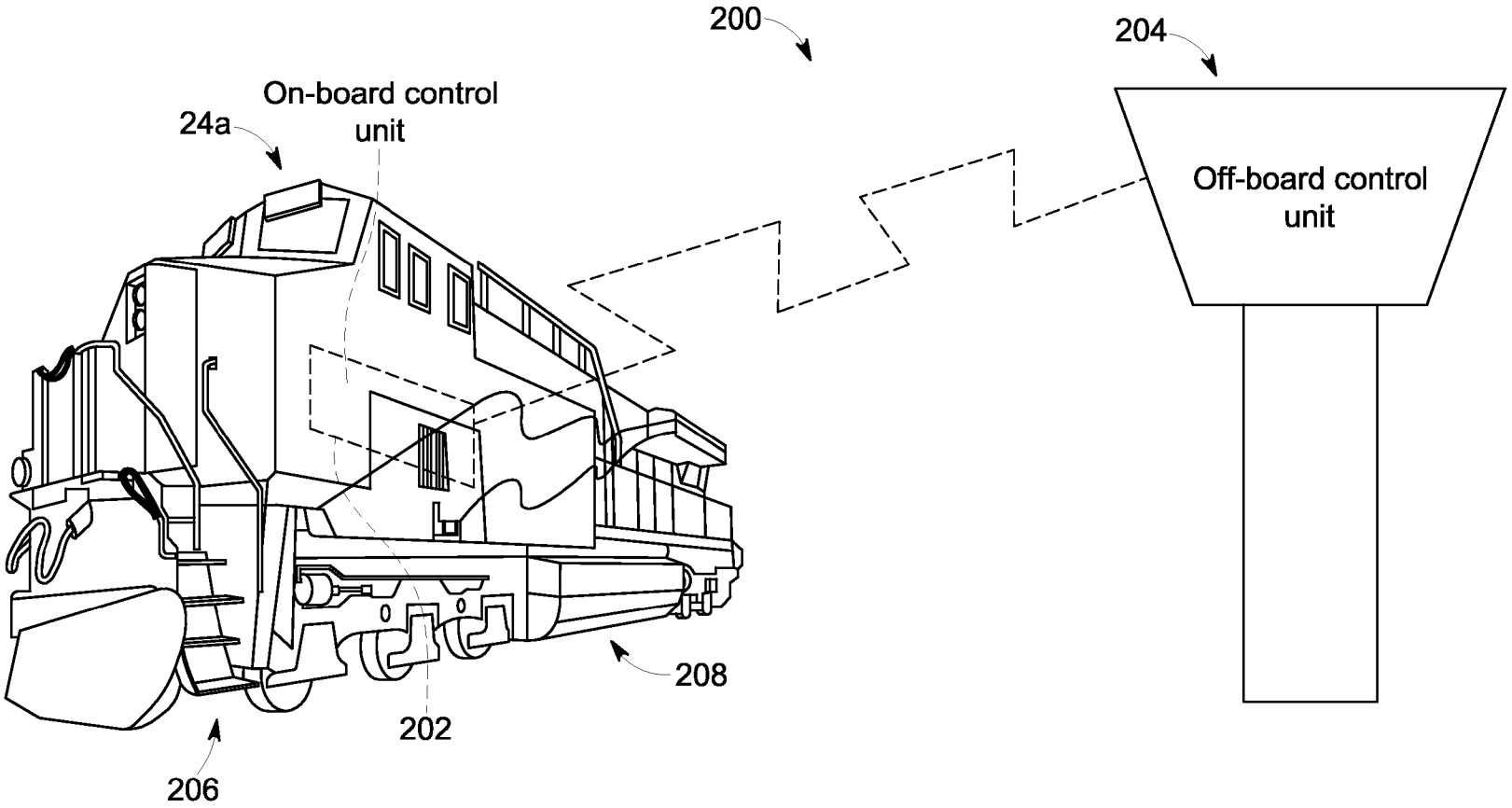
FIG. 2 illustrates in perspective schematic view a tower control system according to an embodiment of the present invention.
Figure 3:
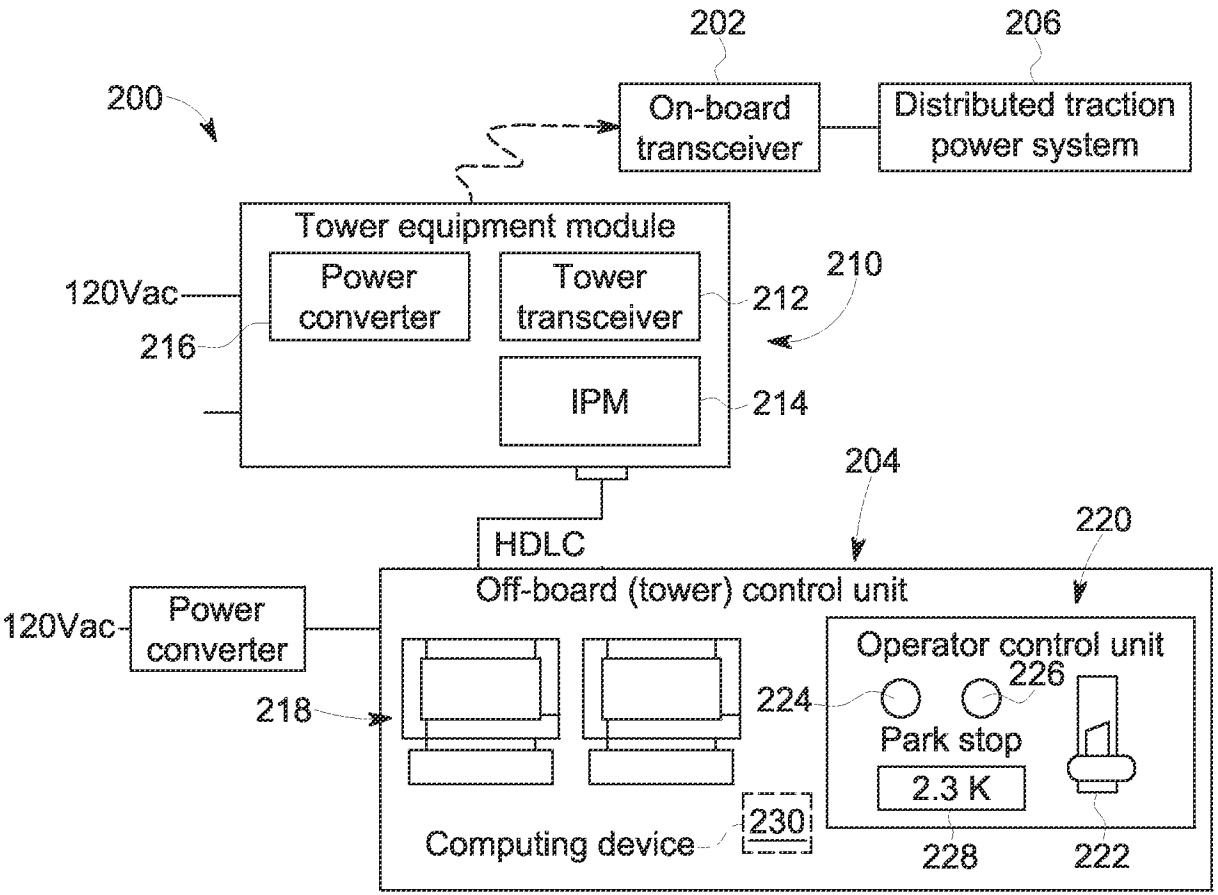
FIG. 3 illustrates in schematic view the tower control system shown in FIG. 2.
Figure 4:
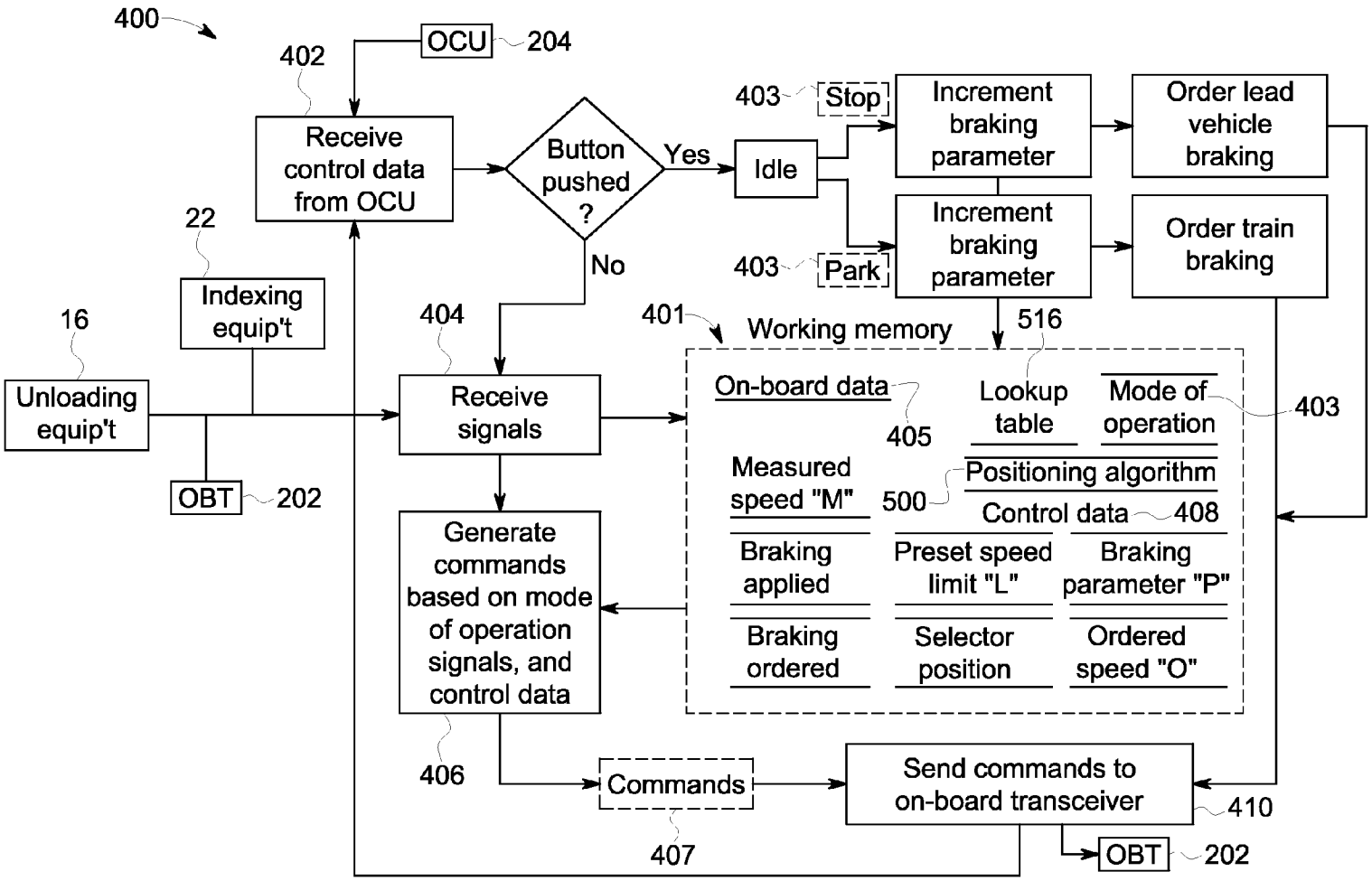
FIG. 4 illustrates in flow diagram view a process accomplished by the tower control system shown in FIGS. 2-3.

In embodiments of the invention, as shown in FIGS. 2-4, a tower control system 200 is commissioned for use in the rail yard 10. The tower control system 200 is configured to provide a positioning mode of operation 500 (FIG. 5) in response to certain conditions.

Referring to FIGS. 2-4, the tower control system 200 includes an off-board control unit 204 which is configured for communication with a transceiver 202 onboard the lead locomotive or other powered rail vehicle 24*a*. The on-board transceiver 202 is in communication with a traction power system 206 of the lead powered rail vehicle 24*a*, and with sensors 208 that may be installed on the wagons 18 as well as on the lead powered rail vehicle. Although wireless radio communication will be shown and described hereinafter, the invention is not so limited, and may include at least laser, acoustic, or through-rail electrical modes of communication as well as any equivalents apparent to those of ordinary skill in light of this disclosure. In particular embodiments, the traction power system 206 is a distributed power system, in which the on-board transceiver 202 is in communication with, and controls, a plurality of fundamentally separate traction power sources that are temporarily joined together—e.g., two or more powered rail vehicles 24*a*, 24*b* that are hitched together in the rail vehicle consist 20. However, the invention is not limited solely to distributed traction power systems, but is equally applicable to trains or other rail vehicle consists with only a single source of traction power (single powered rail vehicle).

FIG. 3 shows further details of the control system 200, which may include a tower equipment module 210 that houses a tower transceiver 212 for intermediating communication between the off-board control unit 204 and the on-board transceiver 202. The tower equipment module also may house an integrated processor module (IPM) 214 and a power converter 216. In some embodiments, the power converter receives 120 Vac and supplies 13.6 and 72 Vdc.

As shown in FIG. 3, according to one embodiment of the invention, the off-board control unit 204 includes multiple displays 218 on which a desired speed setting and measured vehicle speed are shown, as well as an operator control unit (OCU) 220. Each display is a remote session based device connected to the IPM 214, which handles all control signals and consist data for the operator displays 218. The OCU 220 includes at least the following controls: a multi-position selector 222, a PARK button 224, and a STOP button 226. In some embodiments, the OCU also may include an auxiliary display 228 as shown. In some embodiments, the selector 222 may include a dial, a switch, a position encoder, or any equivalent device suitable for selecting among more than two options. In some embodiments, the buttons 224, 226 may be spring-return push buttons. Toggle switches, sliders, or the like are equally suitable. In certain embodiments, the functions of the two buttons 224, 226 may be combined into a single component, for example, a three-way selector switch. In select embodiments the functions of the two buttons 224, 226 may be combined into the selector 222, or the buttons may be mounted on the selector. The selector 222 as well as the buttons 224, 226 and the optional display 228 are shown and described herein as being physically separate components within an assembled unit, however, the displays 218 and the OCU 220 equally can be implemented partly or entirely via a single advanced interface such as a touch-screen.

The displays 218, 228 and the OCU 220 are coordinated by a computing device 230. "Computing device" as used herein refers to either a general purpose integrated circuit, a custom ASIC, an FPGA, a custom analog circuit, or other like device. As shown in FIG. 3, the computing device 230 is connected with the integrated processor module 214 via a point-to-point high-level data link control ("HDLC") layer. In certain embodiments, the functionality of the computing device 230 may be implemented in the IPM 214 itself.

As illustrated in FIG. 4, the computing device 230 is configured to implement a continuous-loop control process 400 for generating and sending commands 407 to the on-board transceiver 202 via the IPM 214 and the tower transceiver 212. In implementation of the process 400, the computing device 230 makes use of a working memory 401. The working memory 401 may be composed of any electronically or optically read-writeable media, such as EEPROM, NAND flash, SDRAM, a hard drive, an optical disc, vacuum tubes, a capacitor bank, or other equivalent structures apparent to those of ordinary skill.

Each iteration of the process 400 includes a step 402 of checking and setting a mode of operation 403 of the off-board control unit 204. For example, pressing one of the STOP button 224 or the PARK button 226 establishes a corresponding mode of operation 403 of the off-board control unit 204 that causes the computing device 230 to generate and send to the on-board transceiver 202, via the tower transceiver 212, commands that idle the traction power system and that order braking of a powered rail vehicle 24 or of the entire rail vehicle consist 20, respectively.

After checking the mode of operation, the process 400 proceeds to a step 404 of receiving signals from the on-board transceiver 202 and/or from other sources within the rail yard 10 including the unloading equipment 16 or the indexing equipment 22. (Here "rail yard" is meant to include any arrangement of tracks off of a main line, including humpyards, sorting yards, or unloading loops/depots as discussed above).

The computing device 230 stores received signals in the working memory 401 as on-board data 405. The on-board data 405 may include a measured speed "M" as well as indications that braking has been applied or that a braking order has been received in the rail vehicle where the on-board transceiver is installed. The measured speed "M" may be obtained by the on-board transceiver 202 from a control system on some powered rail vehicles or from a trainline interface module (TIM) on some other powered rail vehicles.

Next, at a step 406 the computing device 230 generates commands 407 to be sent to the on-board transceiver. The commands 407 are generated according to an algorithm, which corresponds to the mode of operation 403. The algorithm generates the commands 407 with reference to the on-board data 405 and further with reference to control data and internal signals 408 that are stored in the working memory 401. Exemplary modes of operation 403, and on-board data 405, have been discussed above. The control data and internal signals 408 may include the braking parameter "P", a preset speed limit "L", a selector position "H", and an ordered speed "O". At a step 410 the tower control system 200 then sends the commands 407 to the on-board transceiver 202 before looping back to again check for control data input from the off-board control unit 204.

Figure 5:
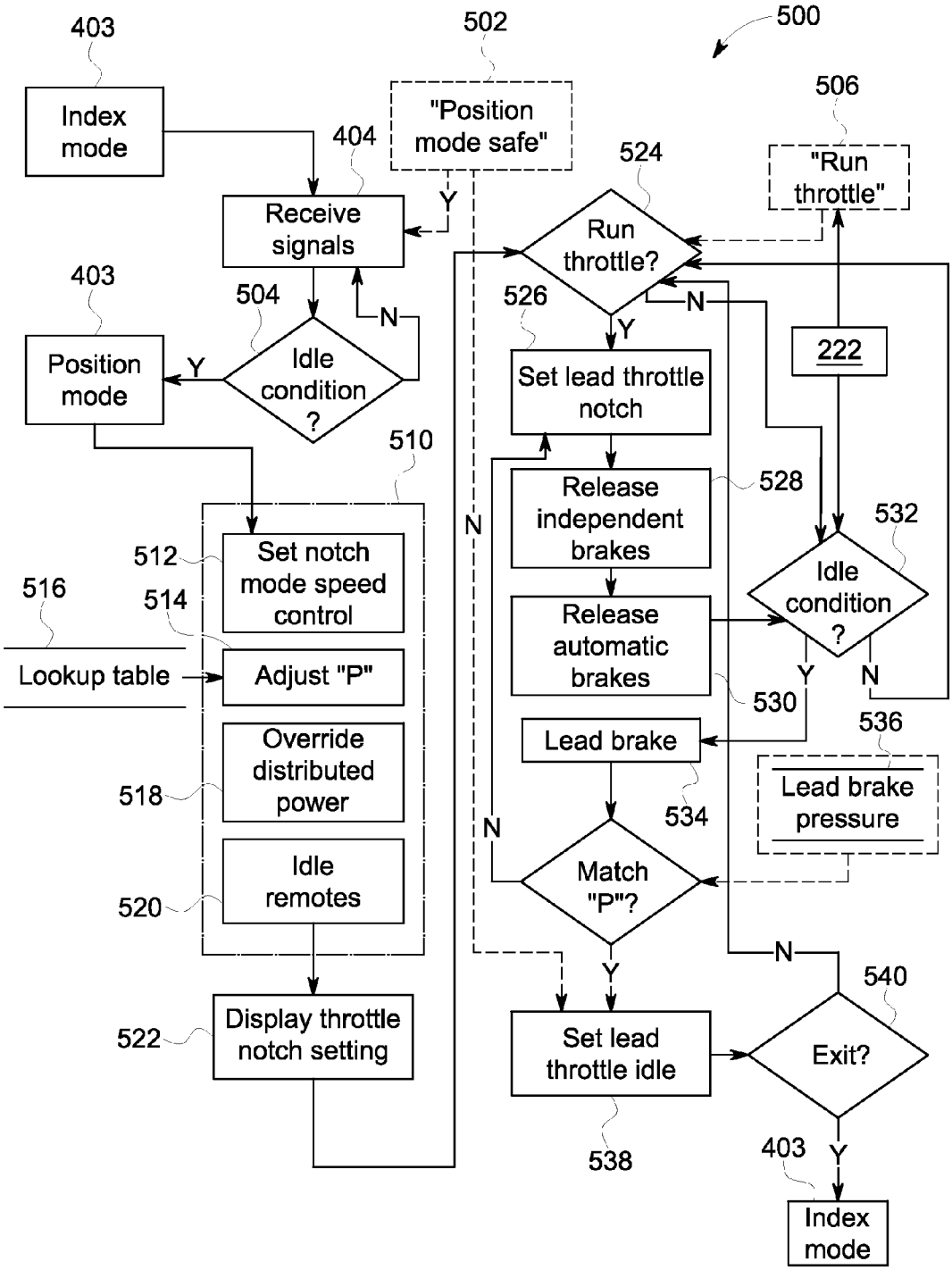
FIG. 5 illustrates in flow diagram view an algorithm accomplished by the tower control system shown in FIGS. 2-3, according to one aspect of the present invention.

Referring to FIG. 5, according to one aspect of the present invention the tower control system 200 can be configured to establish a "positioning" mode of operation 403 and to generate the commands 407 according to a corresponding positioning algorithm 500, as follows.

First, at the step 404 (FIGS. 4 and 5), the off-board control unit 204 receives a first signal 502 from the indexing equipment or other rail yard equipment 22 that is disposed within the rail yard 10. (The first signal may be a POSITION MODE SAFE signal indicative that the rail yard equipment is currently in a state where the positioning mode of operation can be safely carried out.) In case the tower control system 200 is presently in an "indexing" mode of operation 403 (generally as discussed above), then this signal 502 causes the tower control system to verify at a step 504 whether it is in an IDLE condition (e.g., with reference to FIG. 3, the multi-position selector 222 is set to a "CENTER", "C", or "IDLE" selection; or one of the PARK or STOP buttons 224, 226 has been pressed).

Referring again to FIG. 5, upon verifying the IDLE condition, then the tower control system 200 begins to execute its positioning algorithm 500. Under this algorithm 500, the tower control system 200 is configured to permit movement of the lead powered rail vehicle 24*a* for relieving pressure on consist couplers or for positioning the lead powered rail vehicle relative to the dumper cage or other unloading equipment 16. Accordingly, the computing device 230 performs the following step 510 to generate a second signal comprising one or more commands 407:

At step 510, the computing device 230 inserts a command signal 512 for changing the lead powered rail vehicle 24*a* movement mode from speed control mode to throttle notch mode (default throttle notch 1). Throttle notches are discrete levels of powered rail vehicle engine throttle, which roughly correlate to the tractive effort produced by the powered rail vehicle's traction motors. In one embodiment of the invention, there are eight throttle notch settings, plus an IDLE setting. One reason for going into discrete throttle notch control for purposes of the positioning algorithm 500 is to limit the amount of tractive effort generated on the lead powered rail vehicle 24*a*. Another method for limiting powered rail vehicle tractive effort involves modification of the speed control software of the powered rail vehicle, which varies from powered rail vehicle type to powered rail vehicle type. Another reason for going into discrete throttle notch control is that this is a "pseudo open loop" control mode, where operator judgment controls adjustment of the throttle setting within performance limits enforced by the tower control system 200. For example, instead of automatically adjusting the throttle setting to approach an ordered speed at a design rate of acceleration (speed control mode), in throttle notch control mode the tower control system will maintain an ordered throttle unless a speed limit is met or exceeded, in which case the tower control system will "cut" or idle the throttle and possibly apply brakes to keep speed within limits.

At step 510 the computing device 230 also inserts a command signal 514 for adjusting the braking pressure parameter "P" to a value that is sufficient to prevent the rail vehicle consist 20 from rolling backwards in case all throttles are set to IDLE. A "sufficient" value of the brake pressure "P" can vary under operating conditions, is typically determined as part of the test and commissioning of the tower control system 200, and is sent by the tower control system to the lead powered rail vehicle as part of the second signal. For example, the pressure "P" may be selected from a lookup table 516 (also stored in the working memory 401, shown in FIG. 4), which indexes various values of braking pressure with reference to the lead powered rail vehicle 24*a* position within the rail yard, and optionally also with reference to consist data including car weights. Alternatively, the pressure "P" may be determined based on the highest pressure ordered to stop (e.g., actuating the STOP button) the rail vehicle consist 20 at its most recent stopped position.

At step 510, the computing device 230 inserts a command signal 518 to override or interrupt a distributed power control mode affecting remote powered rail vehicles 24*b* (if any) of the rail vehicle consist 20. The computing device 230 also inserts another command signal 520 to set remote powered rail vehicle throttle(s) at idle, and waits for receipt of a RUN THROTTLE signal (i.e., signal indicating a commanded change of throttle) from an operator interface, such as the multi-position selector 222.

At step 522, the tower control system operator display 218 changes from displaying set speed to displaying throttle notch setting. Prior to commencement of movement, throttle IDLE is displayed.

At step 524, the computing device 230 checks for the RUN THROTTLE signal 506 (which can be initiated, e.g., by operator actuation of the multi-position selector 222; alternatively, via soft key on display 218, pre-programmed time function, configurable parameter, etc.). On receipt of the RUN THROTTLE signal 506, the computing device 230 inserts a command signal 526 to adjust the setting of the lead powered rail vehicle 24*a* throttle. For example, for each time increment that the multi-position selector 222 is held away from its IDLE position, then the computing device 230 will increment the command signal 526 by one throttle notch (up to but not exceeding a pre-defined throttle notch limit, for example, not to exceed notch setting N2). The computing device further inserts a command signal 528 to set independent (e.g., locomotive) brake(s) at release, and another command signal 530 to set automatic brakes at release, regardless of lead powered rail vehicle 24*a* throttle and brake status.

At step 532, in response to the multi-position selector 222 being released to IDLE position (or in response to pressing a PARK or STOP button 224 or 226, or in response to touching a soft button of the display 218), the computing device 230 inserts a braking command signal 534, then continuously monitors the on-board data 405 to check lead powered rail vehicle brake pressure 536. Until the lead powered rail vehicle brake pressure 536 reaches the braking pressure parameter "P", the computing device 230 continues to insert the same throttle setting command signal 526 as was being sent before the multi-position selector was idled. Thus, tractive effort is maintained to prevent back slippage of the lead powered rail vehicle 24*a* until adequate braking is provided to hold the rail vehicle consist.

On matching lead powered rail vehicle brake pressure 536 to the braking pressure parameter "P", at step 538 the computing device 230 inserts a command signal to idle the lead powered rail vehicle throttle. At step 540, the computing device 230 checks for a signal whether to exit from positioning mode, and, in case such signal is received, restores the "indexing" mode of operation 403.

As will be readily appreciated, in aspects of the present invention, a tower control system operator is given direct control over the tractive effort exerted by a lead powered rail vehicle of a rail vehicle consist, during positioning of the rail vehicle consist for bulk unloading. As a result, the rail vehicle consist can be smoothly and quickly aligned by an experienced operator to a desired position where the rail vehicle consist will not impact or rest against unloading equipment. Thus, risks of damage or improper operation are reduced.

In aspects, a tower control system, under an indexing mode of operation, receives a first signal from rail yard equipment. In response to the first signal, the tower control system establishes a positioning mode of operation. Under the positioning mode of operation, and in response to actuation of an interface of the tower control system, the tower control system sends a second signal to a lead powered rail vehicle of a rail vehicle consist. The second signal may include a first command to adjust a throttle setting of the lead powered rail vehicle, along with a second command to idle a throttle of any remote powered rail vehicle of the consist. For example, the first command may be a command to idle the throttle of the lead powered rail vehicle. As another example, the second signal may include a third command to release independent brakes of the lead powered rail vehicle. As another example, the second signal may include a fourth command to release automatic brakes of the consist. In some aspects, establishing the positioning mode of operation may include preliminary steps of verifying the indexing mode of operation and verifying an idle condition, such that the positioning mode of operation will not be established if one or more of these conditions is not verified. For example, verifying an idle condition may include verifying an IDLE status of an interface of the tower control system. In some aspects, establishing the positioning mode of operation may include updating a display of the tower control system to indicate a throttle setting. In some aspects, establishing the positioning mode of operation may include setting in the tower control system a maximum limit for adjusting the throttle setting of the lead powered rail vehicle. In some aspects, the tower control system may exit the positioning mode of operation by re-establishing the indexing mode of operation while sending a third signal from the tower control system to the lead powered rail vehicle. The third signal may include a fifth command to idle the throttle of the lead powered rail vehicle and a sixth command to apply independent brakes of the lead powered rail vehicle. In some aspects, exiting the positioning mode of operation may be done in response to actuation of a multi-position selector to a CENTER position, or in response to actuation of a STOP button or of a PARK button. In some aspects, exiting the positioning mode of operation includes maintaining a current throttle setting of the lead powered rail vehicle while incrementally increasing a braking pressure of the lead powered rail vehicle until a braking parameter is met, then idling the throttle of the lead powered rail vehicle.

In embodiments, a system for controlling a rail vehicle, e.g., a tower control system, includes an off-board control unit and an operator control unit. The off-board control unit is operatively connected with the operator control unit, and is configured for communication with an on-board transceiver, which is mounted in a rail vehicle and operatively connected with at least one power system of the rail vehicle. The off-board control unit is further configured for communication with rail yard equipment disposed in a rail yard proximate the rail vehicle. The operator control unit operatively connected with the off-board control unit includes a selector manually movable to a plurality of pre-determined positions, such that in response at least to movement of the selector among the pre-determined positions, the off-board control unit establishes corresponding modes of operation. The off-board control unit is configured to establish a positioning mode of operation, corresponding to one of the pre-determined positions of the selector, in response to a first signal received from the rail yard equipment. In the positioning mode of operation the off-board control unit is configured to transmit to the on-board transceiver second signals (e.g., a series of command signals) for positioning the rail vehicle independently from a rail vehicle consist of which the rail vehicle is a part. In some embodiments, the series of command signals may include a signal for setting a throttle control (e.g., notch) of the rail vehicle. In some embodiments, the series of command signals may include a signal for adjusting a braking parameter of the rail vehicle. In some embodiments, the off-board control unit may be configured to generate the signal for adjusting the braking parameter based on comparison of the rail vehicle location to a lookup table that indexes braking parameter values by locations within a rail yard where the rail vehicle is located. In some embodiments, the second signals may include a signal for overriding a distributed power configuration of the of the rail vehicle consist. For example, the second signals may include a signal for idling throttles of remote powered rail vehicles that the off-board control unit controls via the on-board transceiver. For example, the second signals may include a signal for releasing brakes of remote powered rail vehicles that the off-board control unit controls via the on-board transceiver. Some embodiments also include indexing equipment that is configured to adjust a position of the rail vehicle and to send to the off-board control unit a first signal (e.g., POSITION MODE SAFE signal) that indicates that the rail vehicle is ready for the off-board control unit to establish the positioning mode of operation. In some embodiments, the off-board control unit may be further configured to exit from the positioning mode of operation in response to the selector being moved to a neutral or IDLE position. In some embodiments, exiting the positioning mode of operation may include (i) maintaining a current throttle setting of the rail vehicle; (ii) ordering a braking pressure of the rail vehicle to match a pre-determined braking parameter; and (iii) idling the throttle of the rail vehicle. For example, the braking parameter may be set based on comparison of the rail vehicle location to a lookup table indexing braking parameter values by locations within a rail yard where the rail vehicle is located.

In embodiments, a system for remotely controlling a rail vehicle consist, e.g., a tower control system, is configured for communication with the rail vehicle consist and to receive a first signal from rail yard equipment. The tower control system comprises an interface, and is configured to transition from an indexing mode of operation to a positioning mode of operation responsive to receiving the first signal. When operative in the positioning mode of operation and in response to actuation of the interface, the tower control system is configured to send a second signal to a lead powered rail vehicle of the rail vehicle consist. The second signal may include a first command to adjust a throttle setting of the lead powered rail vehicle and a second command to idle a throttle of any remote powered rail vehicle of the rail vehicle consist.

In embodiments, a system for controlling a rail vehicle includes an on-board transceiver mounted in the rail vehicle and operatively connected with at least one power system of the rail vehicle. The on-board transceiver is configured to receive from an off-board control unit, not mounted in the rail vehicle, command signals for positioning the rail vehicle independently from a rail vehicle consist of which the rail vehicle is a part. For example, the command signals may include a signal for setting a throttle control (e.g., notch) at the on-board transceiver, a signal for adjusting a braking parameter in the on-board transceiver, and a signal for discontinuing a distributed power control mode of operation of the rail vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. §122, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described apparatus and method for consist positioning, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A system for controlling a rail vehicle, said system comprising:

an off-board control unit configured for communication with an on-board transceiver, which is mounted in the rail vehicle and operatively connected with at least one power system of the rail vehicle, said off-board control unit further configured for receiving a first signal from rail yard equipment disposed in a rail yard proximate the rail vehicle; and an operator control unit operatively connected with the off-board control unit and including a selector manually movable to a plurality of pre-determined positions, such that in response at least to movement of the selector among the pre-determined positions, the off-board control unit is configured to establish corresponding modes of operation, wherein the off-board control unit is configured to establish a positioning mode of operation, corresponding to one of the pre-determined positions of the selector, in response to the first signal received from the rail yard equipment, and wherein when operating in the positioning mode of operation the off-board control unit is configured to transmit to the on-board transceiver second signals for positioning the rail vehicle independently from a rail vehicle consist of which the rail vehicle is a part.

2. A system as claimed in claim 1, wherein the second signals comprise a signal for setting a throttle control of the rail vehicle.

3. A system as claimed in claim 1, wherein the second signals comprise a signal for adjusting a braking parameter of the rail vehicle.

4. A system as claimed in claim 3, wherein the off-board control unit is configured to generate the signal for adjusting the braking parameter based on comparison of a location of the rail vehicle to a lookup table that indexes braking parameter values by locations within the rail yard where the rail vehicle is located.

5. A system as claimed in claim 1, wherein the second signals comprise a signal for overriding a distributed power configuration of the rail vehicle consist.

6. A system as claimed in claim 1, wherein the second signals comprise a signal for idling throttles of remote powered rail vehicles that the off-board control unit controls via the on-board transceiver.

7. A system as claimed in claim 1, wherein the second signals comprise a signal for releasing brakes of remote powered rail vehicles that the off-board control unit controls via the on-board transceiver.

8. A system as claimed in claim 1, wherein the rail yard equipment comprises indexing equipment configured to adjust a position of the rail vehicle and to send to the off-board control unit the first signal indicating the rail vehicle is ready for the off-board control unit to establish the positioning mode of operation.

9. A system as claimed in claim 1, wherein the off-board control unit is further configured to exit from the positioning mode of operation in response to the selector being moved to a neutral or IDLE position.

10. A system as claimed in claim 9, wherein the off-board control unit is further configured to exit from the positioning mode of operation by maintaining a current throttle setting of the rail vehicle;

ordering a braking pressure of the rail vehicle to match a pre-determined braking parameter; and idling the throttle of the rail vehicle.

11. A system as claimed in claim 10, wherein the braking parameter is set based on comparison of a location of the rail vehicle to a lookup table indexing braking parameter values by locations within the rail yard where the rail vehicle is located.

12. A system for remotely controlling a rail vehicle consist, said system comprising:

a tower control system configured for communication with the rail vehicle consist and to receive a first signal from rail yard equipment, the tower control system comprising an interface; and wherein the tower control system is configured to transition from an indexing mode of operation to a positioning mode of operation responsive to receiving the first signal, and wherein the tower control system, when operative in the positioning mode of operation and in response to actuation of the interface, is configured to send from the tower control system a second signal to a lead powered rail vehicle of the rail vehicle consist, said second signal comprising a first command to adjust a throttle setting of the lead powered rail vehicle and a second command to idle a throttle of any remote powered rail vehicle of the rail vehicle consist.

13. A system for controlling a rail vehicle, said system comprising:

an on-board transceiver mounted in said rail vehicle and operatively connected with at least one power system of the rail vehicle, said on-board transceiver configured to receive from an off-board control unit, not mounted in said rail vehicle, command signals for positioning the rail vehicle independently from a rail vehicle consist of which the rail vehicle is a part, said command signals comprising a signal for setting a throttle control of the rail vehicle, a signal for adjusting a braking parameter of the rail vehicle, and a signal for discontinuing a distributed power control mode of the rail vehicle.

* * * * *